US012297843B2

(12) United States Patent
Malone

(10) Patent No.: US 12,297,843 B2
(45) Date of Patent: May 13, 2025

(54) MULTIPORT FLUID PUMP WITH INTEGRATED VALVE

(71) Applicant: COOPER-STANDARD AUTOMOTIVE INC, Northville, MI (US)

(72) Inventor: David S. Malone, Attica, MI (US)

(73) Assignee: Cooper-Standard Automotive Inc., Northville, MI (US)

( * ) Notice: Subject to any disclaimer, the term of this patent is extended or adjusted under 35 U.S.C. 154(b) by 0 days.

(21) Appl. No.: 17/835,222

(22) Filed: Jun. 8, 2022

(65) Prior Publication Data

US 2023/0400037 A1 Dec. 14, 2023

(51) Int. Cl.

| | |
|---|---|
| ***F04D 29/42*** | (2006.01) |
| ***F04D 13/06*** | (2006.01) |
| ***F04D 29/46*** | (2006.01) |
| ***F04D 29/48*** | (2006.01) |

(52) U.S. Cl.

CPC ..... *F04D 29/4293* (2013.01); *F04D 13/06* (2013.01); *F04D 29/468* (2013.01); *F04D 29/486* (2013.01)

(58) Field of Classification Search

CPC ..... F04D 15/0016; F04D 29/4293; F04D 13/028; F04D 15/0005; F04D 5/007; F04D 29/506; F04D 13/06; F04D 1/00; F04D 29/026; F04D 15/0022; F04D 29/486; F04D 15/02

See application file for complete search history.

(56) References Cited

U.S. PATENT DOCUMENTS

| | | | | |
|---|---|---|---|---|
| 4,679,983 A * | 7/1987 | Pietryk | F04D 29/486 415/152.2 |
| 4,869,076 A * | 9/1989 | Sakai | F04D 29/486 62/347 |
| 10,570,921 B2 * | 2/2020 | Geffert | F04D 29/4293 |

(Continued)

FOREIGN PATENT DOCUMENTS

| | | |
|---|---|---|
| DE | 102017208134 A1 | 11/2018 |
| EP | 0380990 A2 * | 8/1990 |

(Continued)

OTHER PUBLICATIONS

US 11,674,256 B2, 06/2023, Choi (withdrawn)*
Extended Search Report for 23178129.5 dated Nov. 6, 2023.

*Primary Examiner* — Dominick L Plakkoottam
(74) *Attorney, Agent, or Firm* — Paschall & Associates, LLC; James C. Paschall; Anthony Miologos

(57) ABSTRACT

A pump assembly is disclosed comprising a pump including a pump housing having a fluid inlet conveying fluid to a pump cavity At least one fluid outlet extends from the pump housing. A plurality of fluid outlet ports extend from the pump housing. An impeller driven by a motor drives the fluid in the pump cavity. In a first embodiment, a valve member rotatably mounted between the impeller and the plurality of fluid outlet ports is arranged to selectively direct the flow of fluid from the pump cavity to one or more of the plurality of fluid outlet ports. In a second embodiment, the valve member includes a first and a second wall between a first and a second opening. The first and second openings are arranged to direct the flow of fluid from the pump cavity to at least two of the plurality of fluid outlet ports.

8 Claims, 9 Drawing Sheets

(56) References Cited

U.S. PATENT DOCUMENTS

| | | | | |
|---|---|---|---|---|
| 10,823,175 | B2 | 11/2020 | Blad et al. | |
| 11,377,778 | B2 * | 7/2022 | Kim | F04D 13/086 |
| 11,525,458 | B2 * | 12/2022 | Hinrichs | F04D 29/426 |
| 2004/0173249 | A1 * | 9/2004 | Assmann | F16K 15/1848 134/179 |
| 2020/0072227 | A1 * | 3/2020 | Blad | F04D 15/0209 |
| 2020/0072238 | A1 * | 3/2020 | Blad | F04D 13/06 |
| 2021/0003133 | A1 * | 1/2021 | Blad | F04D 29/486 |
| 2021/0010477 | A1 * | 1/2021 | Blad | F24D 3/105 |
| 2023/0265841 | A1 | 8/2023 | Malone | |

FOREIGN PATENT DOCUMENTS

| | | | | | |
|---|---|---|---|---|---|
| GB | 891076 | A * | 3/1962 | | |
| KR | 101735432 | B1 * | 5/2017 | | |
| KR | 102359325 | B1 | 2/2022 | | |
| WO | WO-2009070565 | A1 * | 6/2009 | | F04D 15/0016 |

* cited by examiner

MULTIPORT FLUID PUMP WITH INTEGRATED VALVE

TECHNICAL FIELD

This disclosure is generally directed to pumps. More specifically, it relates to a pump having an integrated valve that directs fluid flow from the pump through a plurality of fluid outlet ports.

BACKGROUND

Pumps are known and commonly used to move fluids such as coolant in a vehicle. One example is cooling systems with water pumps, which are used for the cooling of different electrical components of the vehicle. These are hybrid or purely electric vehicles since vehicles with internal combustion engines do not comprise any electrical components that need to be cooled. Valves are used to ensure the distribution of the coolant throughout the cooling system. The valves each require an actuator with electrical control mounted on a structure or component of the vehicle, which results in high component costs. Therefore, it is an object of the present disclosure to provide a pump with an integrated valve that can direct fluid flow from the pump through a plurality of fluid outlet ports using a minimal set of components.

SUMMARY

This disclosure relates to a pump having an integrated valve that directs fluid flow from the pump through a plurality of fluid outlet ports.

In a first embodiment a pump assembly is disclosed comprising a pump housing having a pump cavity and a fluid inlet that conveys fluid into the pump cavity. A plurality of fluid outlet ports extend from the pump housing. An impeller driven by a motor drives the fluid in the pump cavity. A valve member rotatably mounted between the impeller and the plurality of fluid outlet ports is arranged to selectively direct the flow of fluid from the pump cavity to one or more of the plurality of fluid outlet ports.

In a second embodiment A multiport fluid pump is disclosed comprising a pump housing having a pump cavity and a fluid inlet that conveys fluid into the pump cavity. A plurality of fluid outlet ports extend from the pump housing. An impeller driven by a motor drives the fluid in the pump cavity. A valve member rotatably mounted between the impeller and the plurality of fluid outlet ports includes a first and a second wall between a first and a second opening. The first and second openings are arranged to direct the flow of fluid from the pump cavity to at least two of the plurality of fluid outlet ports.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

The figures, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

An example pump assembly comprises a pump including a housing having a fluid inlet, a plurality of fluid outlets and an impeller for moving a fluid from the fluid inlet to one or more of the fluid outlets. A pump motor drives the impeller to move the fluid and an integrated valve between the impeller and the plurality of fluid outlets directs the fluid to one or more fluid outlets.

Figure 1:
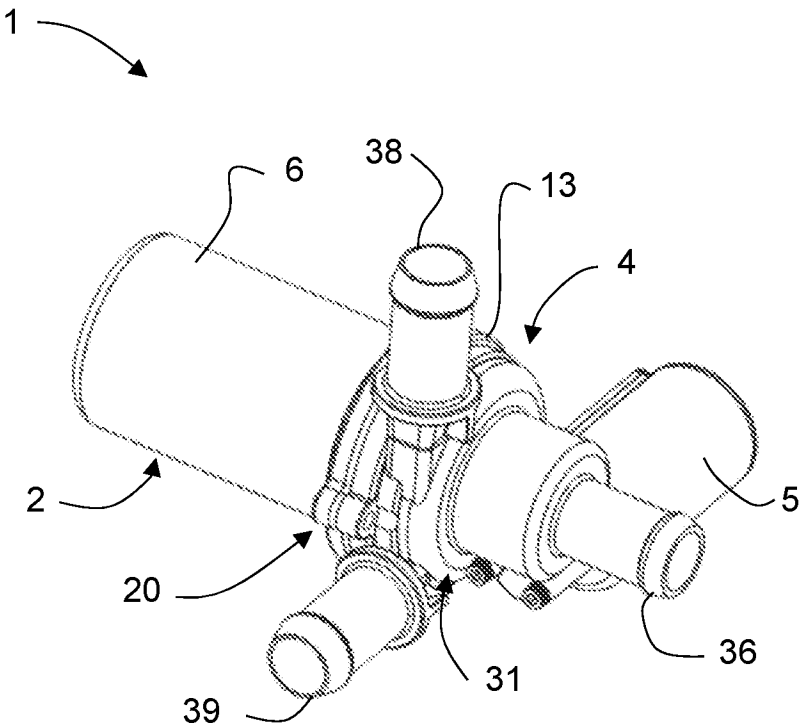
FIG. 1 illustrates a perspective view of an assembled pump assembly of the present disclosure.
Figure 2:
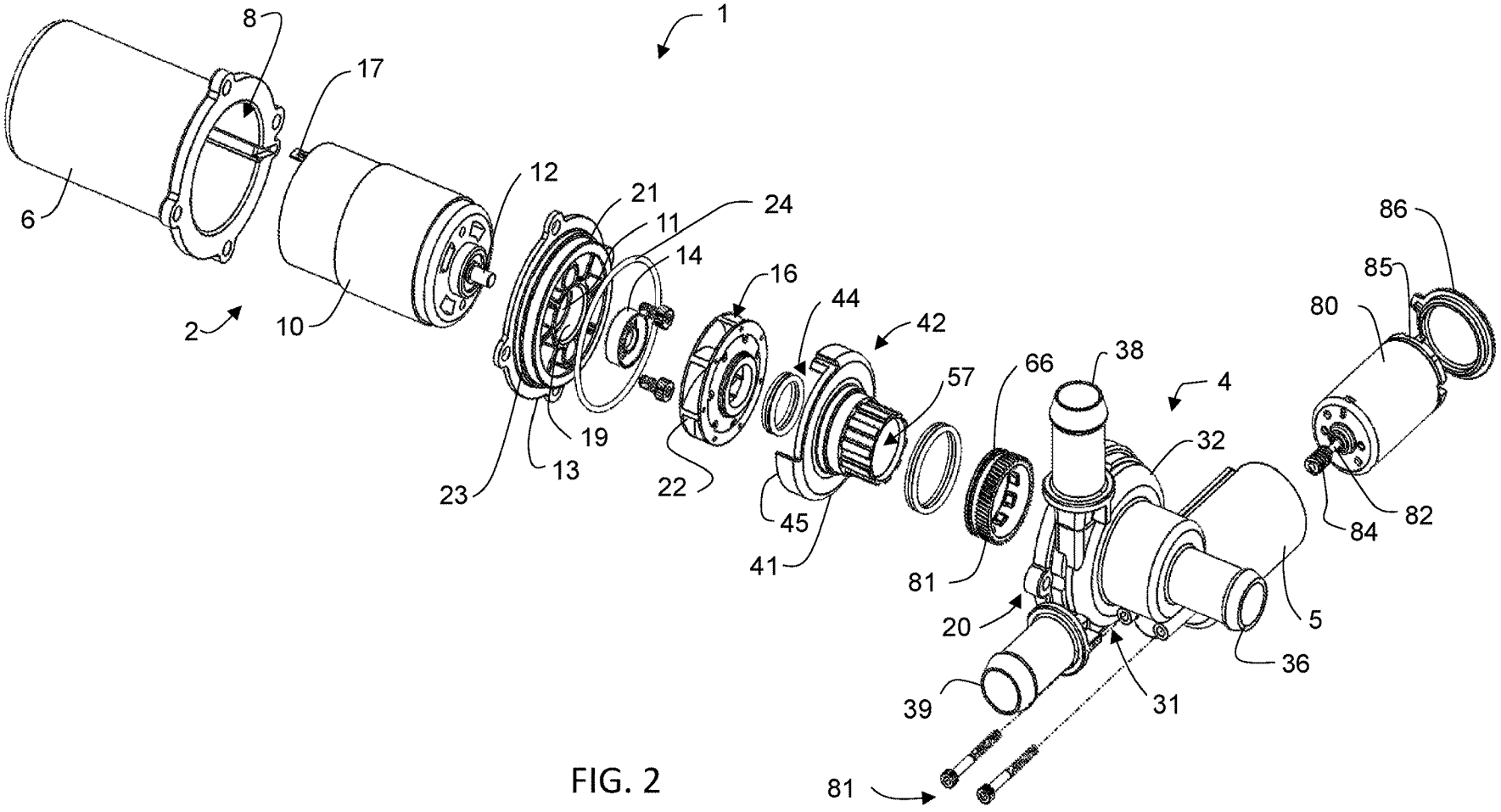
FIG. 2 illustrates an exploded view of the pump assembly of the present disclosure.

FIGS. 1 and 2 illustrate an example pump assembly 1 for pumping a fluid, such as a coolant, in a vehicle. As can be appreciated, the pump assembly 1 may also be used in non-vehicle applications. The example pump assembly 1 is an integration of a pump and a valve for selectively directing the flow of fluid from the pump assembly 1.

The pump assembly 1 includes a pump motor section 2 and a pump section 4. The pump motor section 2 includes a motor housing 6 that forms a motor cavity 8 therein. The pump motor housing 6 supports a pump motor 10 and a motor shaft 12 is installed through opening 11 of a pump motor mounting plate 13. The mounting plate 13 includes a wall 21 extending circumferentially from the mounting plate 13. The wall 21 includes a groove 23 extending along and outer periphery of wall section 21. An elastomeric sealing element, such as for example an O-ring 24 is arranged to be installed in groove 23. A seal member 14 is installed within a seal seat 19 molded on mounting plate 13. An impeller 16 having a plurality of impeller vanes 22 is configured to be rotatable within the pump section 4 driven by the motor shaft 12. The pump motor 10 includes electrical connections 17 that extend from a rear portion of the motor 10 through a rear portion of motor housing 6. The electrical connections 17 adapted to receive electrical power from a remotely located power source to energize and operate the pump motor 10.

Figure 3:
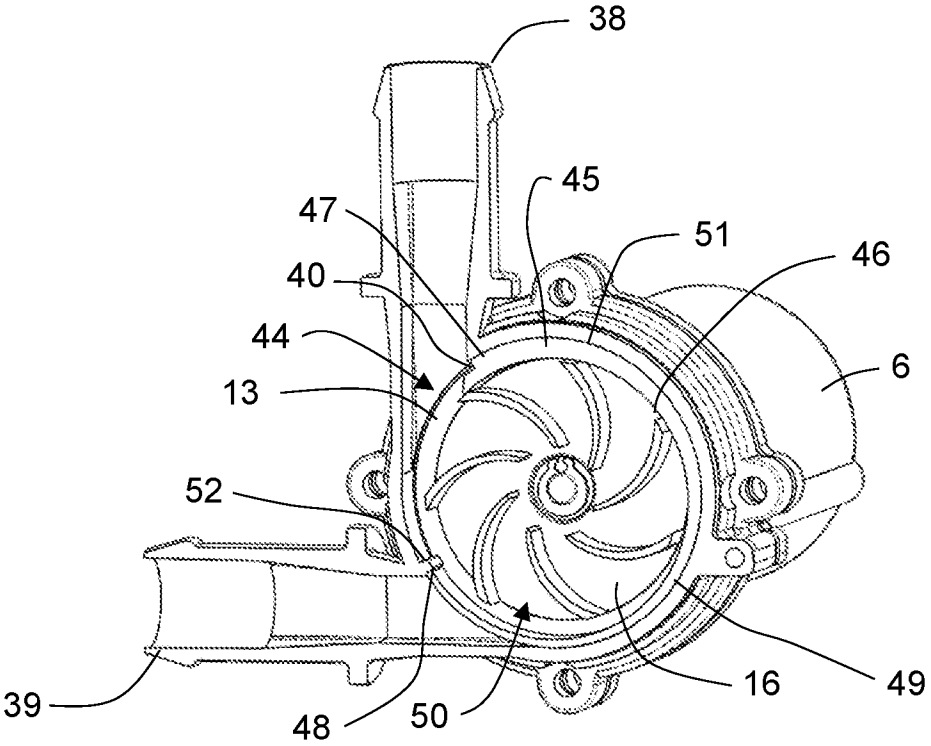
FIG. 3 illustrates a cross-sectional perspective view of a portion of the pump section of the present disclosure.

In the illustrated examples of FIGS. 2 and 3, the pump housing 31 of pump section 4 is formed essentially cylindrically and comprises a peripheral exterior wall 32. A fluid inlet 36, for example a suction inlet for sucking in a fluid, in this example a coolant, is positioned centrally to the rotary axis of the pump housing 31 Fluid from the fluid inlet 36 is directed into a pump cavity 50 through an opening 57 of valve member 42. The pump housing 31 also includes at least one fluid outlet port for discharging fluid from the pump section 4. In this embodiment, two fluid outlet ports 38, 39 are shown that are fluidly connected to the pump cavity 50. A first fluid outlet port 38 and a second fluid outlet port 39 extend from the wall 32 of pump housing 31 and are axially offset from each other such that the centers of the fluid outlet ports 38, 39 in the example, are oriented 90 degrees from the other. It will be appreciated by those skilled in the art, that more than the two fluid outlet ports 38. 39 may extend from pump housing 31 at other convenient orientation as shown in FIGS. 6-9.

An adjustable valve member 42 is radially located outside the impeller 16 and inside the pump cavity 50 as is shown in FIG. 3. The valve member 42 is arranged to adjustably direct the fluid through the respective fluid outlet ports 38, 39. The valve member 42 is comprised of an annular valve element 41 having a wall 45 with an exterior wall surface 49 and an interior wall surface 46 and a rectangular opening 44 extending through wall 45. In this example, wall 45 of the valve element 41 is spirally voluted from a generally thicker wall section at a first end 47 of opening 44 to a generally thinner wall section at a second end 48 of the opening 44. The impeller 16 is arranged to rotate inside the annular valve element 41 and the voluted interior wall surface 46. The pump housing 31 includes a stop member 52 extending into cavity 50. The valve element 41 further includes a stop surface 40 located at first end 47 of opening 44.

Figure 4:
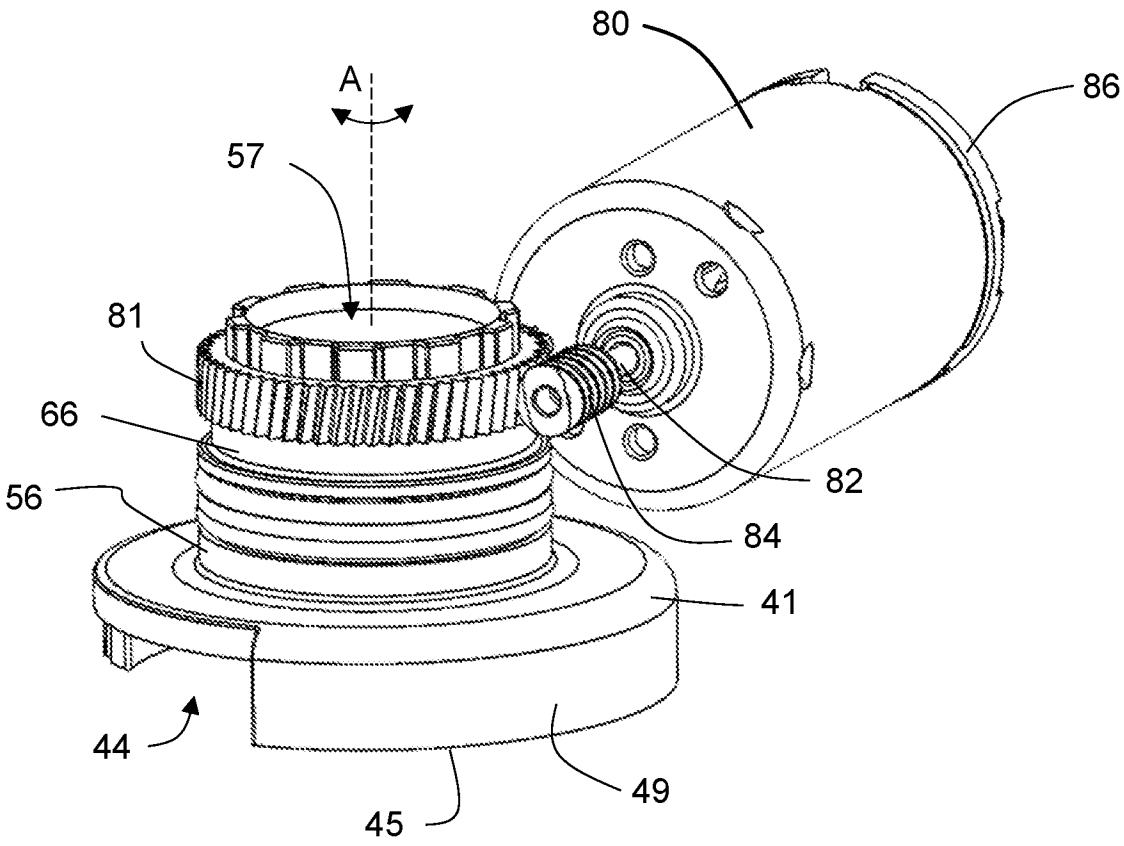
FIG. 4 illustrates a perspective view of the assembly of the valve member and actuator motor of the present disclosure.

FIG. 4 illustrates an upper section 43 of the valve member 42. The upper section 43 includes opening 57 and an actuation ring 66 having a spline tooth gear band 81 attached about the periphery of the outer surface 56 of the upper section 43. The teeth of the gear band 81 are arranged to be mechanically connected to a worm gear member 84 attached to a shaft 82 of an actuator motor 80. The valve member 42 is rotatable about a central axis A to adjust the fluid flow from the pump cavity 50 to fluid outlet ports 38, 39 through opening 44. Rotation of the gear band 81 by worm gear 84 causes rotation of the valve member 42 about central axis A. In this regard, the valve member 42 may be considered to be a rotary valve.

The actuator motor 80 of the present disclosure is arranged to be housed within an actuator motor housing 5 of the pump section 4 as shown in FIGS. 1 and 2. The actuator motor housing 5 is integrally formed with the pump housing 31, such as by injection molding. The actuator motor 80 is secured to actuator motor housing 5 using fasteners 81 and a rear cover plate 86 is installed over electrical section 85. The actuator motor 80 is electrically connected to a remotely located controller through an electrical circuit section 85 on a rear face of the actuator motor 80 using an electrical connector (not shown). The controller selectively signals the actuator motor 80 to rotate worm gear 84 and thereby to cause rotation of valve member 42.

Rotation of the valve member 42 by actuator motor 80 selectively positions opening 44 to direct fluid flow from the pump cavity 50 to the first or the second fluid outlet ports 38, 39 at a maximum fluid flow volume or to both fluid outlet ports 38, 39 at the same time at a reduced fluid flow volume thereby controlling the discharge of fluid from the pump section 4.

Figure 5C:
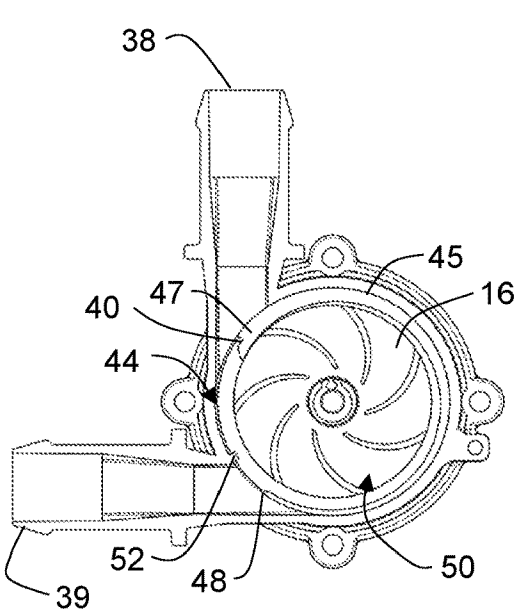
FIG. 5C illustrates a cross-sectional view of a portion of the pump assembly of the present disclosure, with the valve member in a third position.
Figure 5B:
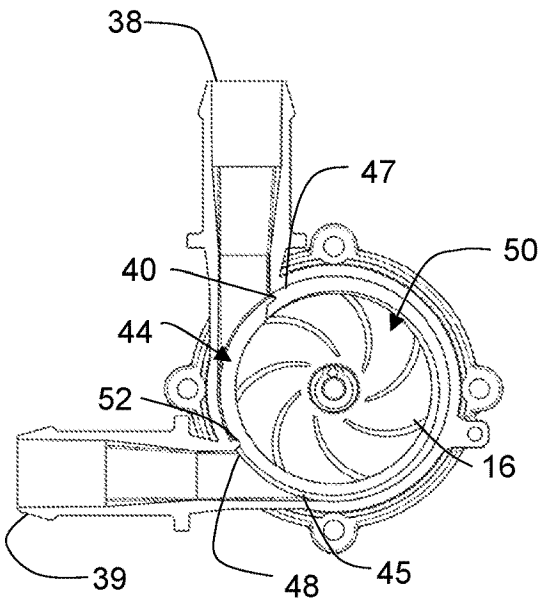
FIG. 5B illustrates a cross-sectional view of a portion of the pump assembly of the present disclosure, with the valve member in a second position.
Figure 5A:
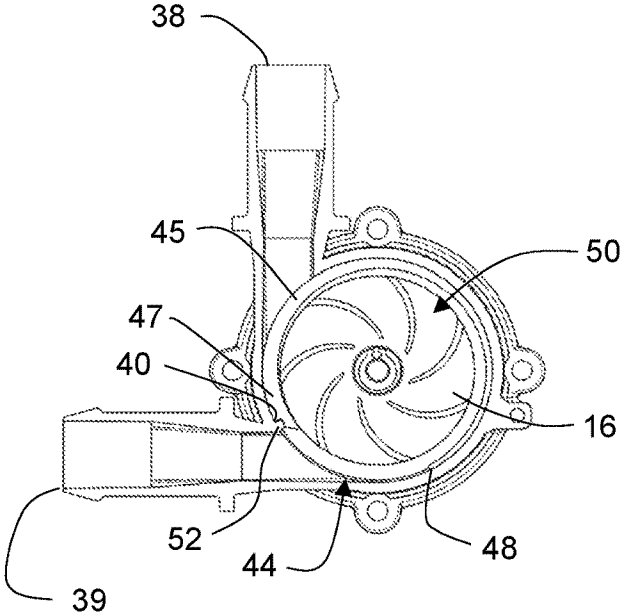
FIG. 5A illustrates a cross-sectional view of a portion of the pump assembly of the present disclosure, with the valve member in a first position.

FIGS. 5A-5C, illustrate a first embodiment of the operation of the valve member 42. In this first embodiment, the valve member 42 includes a single opening 44 extending through wall 45. Wall 45 is spirally voluted from a generally thicker wall section at a first end 47 of opening 44 to a generally thinner wall section at a second end 48 of the opening 44. As is shown, impeller 16 rotates within valve member 42 located inside the pump cavity 50 of the pump housing 31. The pump cavity 50 receives fluid from fluid inlet 36 through opening 57 of the valve member 42. The impeller 16 drives the fluid introduced into the pump cavity 50.

In FIG. 5A the actuator 80 selectably rotates the actuation ring 66 of valve member 42 counterclockwise to position opening 44 into a first valve position that is in alignment with the second fluid outlet port 39. Stop surface 40 located at the first end 47 of opening 44 engages and stops against stop member 52, providing a positive indication of the alignment of opening 44 with second fluid outlet port 39. In the first position fluid in the pump cavity 50 is driven by the impeller 16 and directed entirely through the first fluid outlet port 39 at a maximum flow volume. Wall 45 of the valve member 42 closing off and obstructing flow of the fluid to first fluid outlet port 38.

In FIG. 5B, fluid is discharged from first fluid outlet port 38 by the actuator 80 rotating actuation ring 66 of valve member 42 clockwise to a second valve position. The second valve position aligns opening 44 with the first fluid outlet port 38. In the second position an end portion of second end 48 of opening 44 engages and stops against stop member 52, providing a positive indication of the alignment of opening 44 with first fluid outlet port 38. In the second position fluid is directed from the pump cavity 50 entirely through the first fluid outlet port 38 at a maximum flow volume. Wall 45 closing off and obstructing flow of the fluid to the second fluid outlet port 39.

In FIG. 5C the actuator 80 selectably rotates the actuation ring 66 to position opening 44 in a third valve position located between the first fluid outlet port 38 and the second fluid outlet port 39, causing fluid in pump cavity 50 to be discharged from both fluid outlet ports 38 and 39 at a reduced flow volume. FIG. 5C shows the opening 44 in a location where fluid flow is shared between fluid outlet ports 38, 39. That is, in the third position, opening 44 causes approximately one-half of the fluid volume in pump cavity 50 to be output through first fluid outlet port 38 and approximately the remainder one-half of the fluid volume through the second fluid outlet port 39. It will be well understood by those skilled in the art that based on the location of the opening 44, other proportional output flow may be discharged from fluid outlet ports 38, 39. For example, the actuator 80 may selectably rotate actuation ring 66 to position opening 44 to direct 60 percent of the fluid volume through the first fluid outlet port 38 and 40 percent through the second fluid outlet port 39. Thus, by controlling the position of opening 44 not only does the valve member 42 selectively control from which fluid outlet port fluid is discharged, but also the volume of fluid discharged from fluid outlet ports 38, 39.

Figure 6:
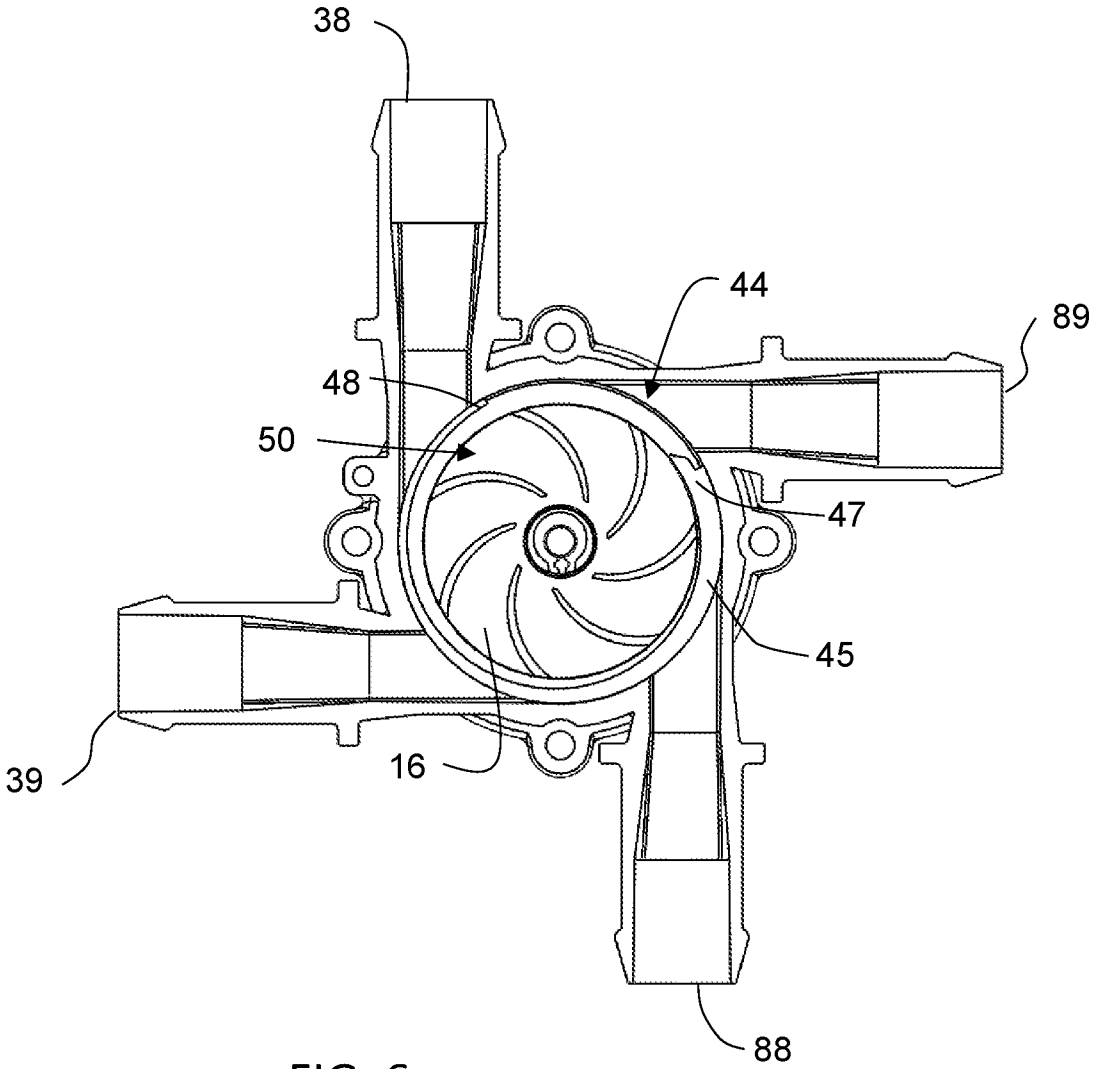
FIG. 6 illustrates a cross-sectional view through a portion of the assembled pump assembly fluid of the present disclosure having four fluid outlet ports.

FIG. 6 illustrates the use of the valve member 42 of the first embodiment of the present disclosure that direct fluid flow from a four-port pump assembly. A third a fluid outlet port 88 extends from pump housing 31 adjacent to and orientated 90 degrees from the first fluid outlet port 39 and a fourth fluid outlet port 89 extends from pump housing 31 and adjacent to and orientated 90 degrees from the first fluid outlet port 39. In FIG. 6 stop member 52 has been removed allowing the valve member 42 to rotate freely within pump cavity 50 without encountering any structures that would stop rotation of the valve member 42 within the pump cavity 50. In FIG. 6 the actuator 80 can now rotate valve member 42 clockwise to position opening 44 into a fourth valve position that aligns the fourth fluid outlet port 89 with opening 44. In the fourth valve position, wall 45 closes the first fluid outlet port 38, the second fluid outlet port 39 and the third fluid outlet port 88. In the fourth valve position fluid in the pump cavity 50 is directed at a maximum flow volume through the fourth fluid outlet port 89.

Further rotation of actuator 80 can rotate valve member 42 further clockwise to a fifth valve position that aligns opening 44 with the third fluid outlet port 88. In the fifth valve position opening 44 is in alignment with the fourth fluid outlet port 88. In the fifth valve position fluid from pump cavity 50 is directed entirely through the fourth fluid outlet port 88 at a maximum flow volume. Wall 45 closing off and obstructing flow of fluid from the pump cavity 50 to the first 38, the second 39 and the third 89 fluid outlet ports.

Opening 44 can be further positioned into a sixth valve position located between the third fluid outlet port 88 and the fourth fluid outlet port 89, causing fluid to be discharged from both fluid outlet ports 88 and 89 similarly as was shown and described in FIG. 5C for fluid outlet ports 38, 39.

Figure 7:
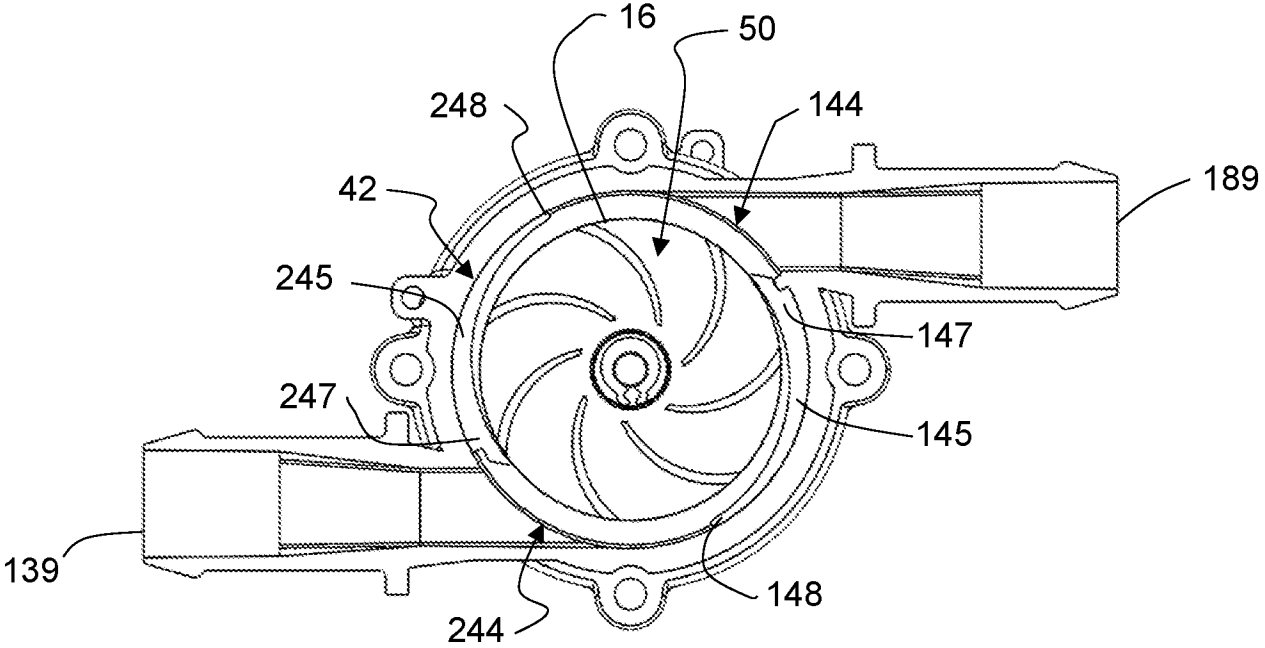
FIG. 7 illustrates a cross-sectional view through a portion of the assembled pump assembly of a second embodiment of the present disclosure having two fluid outlet ports.

FIG. 7 illustrates an example second embodiment of the present disclosure for directing fluid flow from two fluid outlet ports concurrently of a multiport fluid pump. In the second embodiment the valve member 42 is configured to open fluid flow to two fluid outlet ports 189 and 139 of the multiport fluid pump concurrently allowing fluid to flow to each fluid outlet port 189 and 139 at a particular flow volume. The valve member 42 includes a first opening 144 and a second opening 244 oriented on either side of the valve member 42. Each opening 144 and 244 extends through an associated voluted first wall 145 and a voluted second wall 245. First wall 145 is spirally voluted from a generally thicker wall section at a first end 147 adjacent first opening 144 to a generally thinner wall section at a second end 148 adjacent second opening 244. Second wall 245 is spirally voluted from a generally thicker wall section at a first end 247 adjacent second opening 244 to a generally thinner wall section at a second end 248 adjacent first opening 144. In the example of FIG. 7, the first opening 144 is aligned with a first fluid outlet port 189 and the second opening 244 is aligned with a second fluid outlet port 139. Fluid in pump cavity 50 is directed through first opening 144 of the valve member 42 to the first fluid outlet port 189. Concurrently, the second opening 244 of valve member 42 is open to the second fluid outlet port 139 and fluid from pump cavity 50 is directed through opening 244 to the second fluid outlet port 139. A clockwise rotation of valve member 42 by actuator 80 places second wall 245 in a position to close the first fluid outlet port 189 and first wall 145 in a position to close second fluid outlet port 139.

The valve member 42 may also be rotated to place both the first and second openings 144 and 244 in a position that shares fluid flow between the first and the second fluid outlet ports 189 and 139. That is, the valve member 42 may be rotated to position openings 144 and 244 into a position where approximately one-half of the fluid volume from pump cavity 50 flows to the second fluid outlet port 139 and approximately the remainder one-half of the fluid volume through the first fluid outlet port 189. It will be well understood by those skilled in the art that based on the location of the first and second openings 144 and 244 other proportional fluid volume outputs may be discharged from the fluid outlet ports 139 and 189 as explained above in FIG. 5C.

Figure 8:
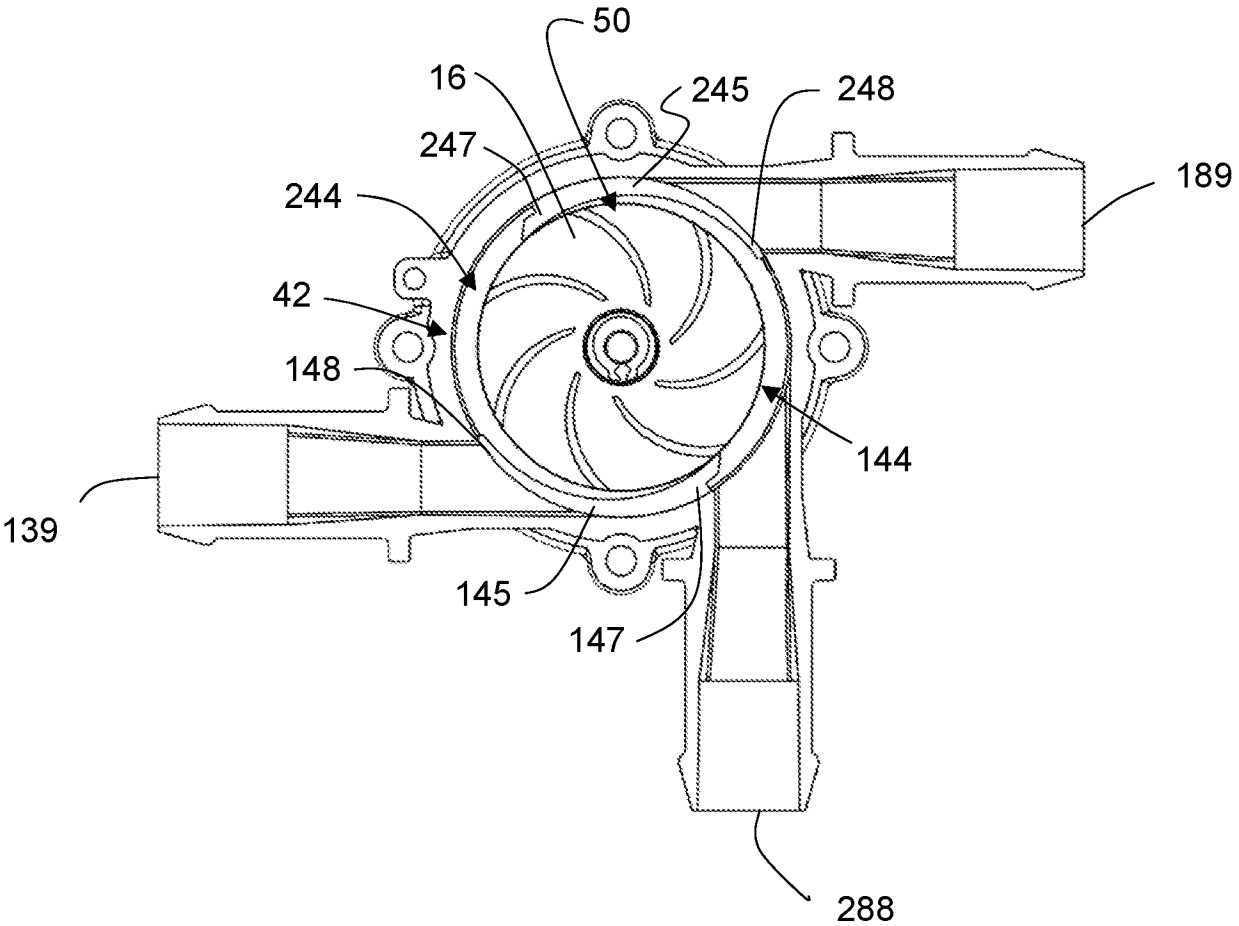
FIG. 8 illustrates a cross-sectional view through a portion of the assembled pump assembly of the second embodiment of the present disclosure having three fluid outlet ports.

FIG. 8 illustrates an example of the second embodiment having a third outlet port 288. The third outlet port 288 arranged to have fluid exit the outlet port 288 when the fluid outlet ports 139 and 189 are closed by first wall 145 and the second wall 245, respectively. The third outlet port 288 extends from the pump housing 31 oriented 90 degrees to the first fluid outlet port 189. When the valve member 42 is rotated to close fluid flow from fluid outlet ports 139 and 189, as explained above, first opening 144 of the valve member 42 aligns with fluid outlet port 288. In this example, fluid from pump cavity 50 is directed through the first opening 144 to the third fluid outlet port 288 when fluid outlet ports 139 and 189 are closed by first and second walls 145 and 245, respectively. It should be noted that even though the example of FIG. 8 shows outlet port 288 extending 90 degrees adjacent to fluid outlet port 189, outlet port 288 may be oriented 90 degrees adjacent to outlet port 139 and still provide fluid to flow from a third outlet port using second opening 244. Similarly, as explained above in FIG. 7, the valve member 42 may be rotated to position the first and second openings 144 and 244 into a position where the openings 144 and 244 are shared between the first, the second and the third fluid outlet ports shown in FIG. 8. For example, rotation of the valve member 42 can place first and second openings 144 and 244 to provide approximately one-third of the fluid volume from pump cavity 50 to the second fluid outlet port 139, another one-third of the fluid volume to the first fluid outlet port 189 and approximately the remainder one-third of the fluid volume to the third fluid outlet port 288. It will be well understood by those skilled in the art that based on the location of the openings 144 and 244, other proportional fluid volumes may be discharged from the fluid outlet ports 139, 189 and 288 as explained above in FIG. 5C.

Figure 9:
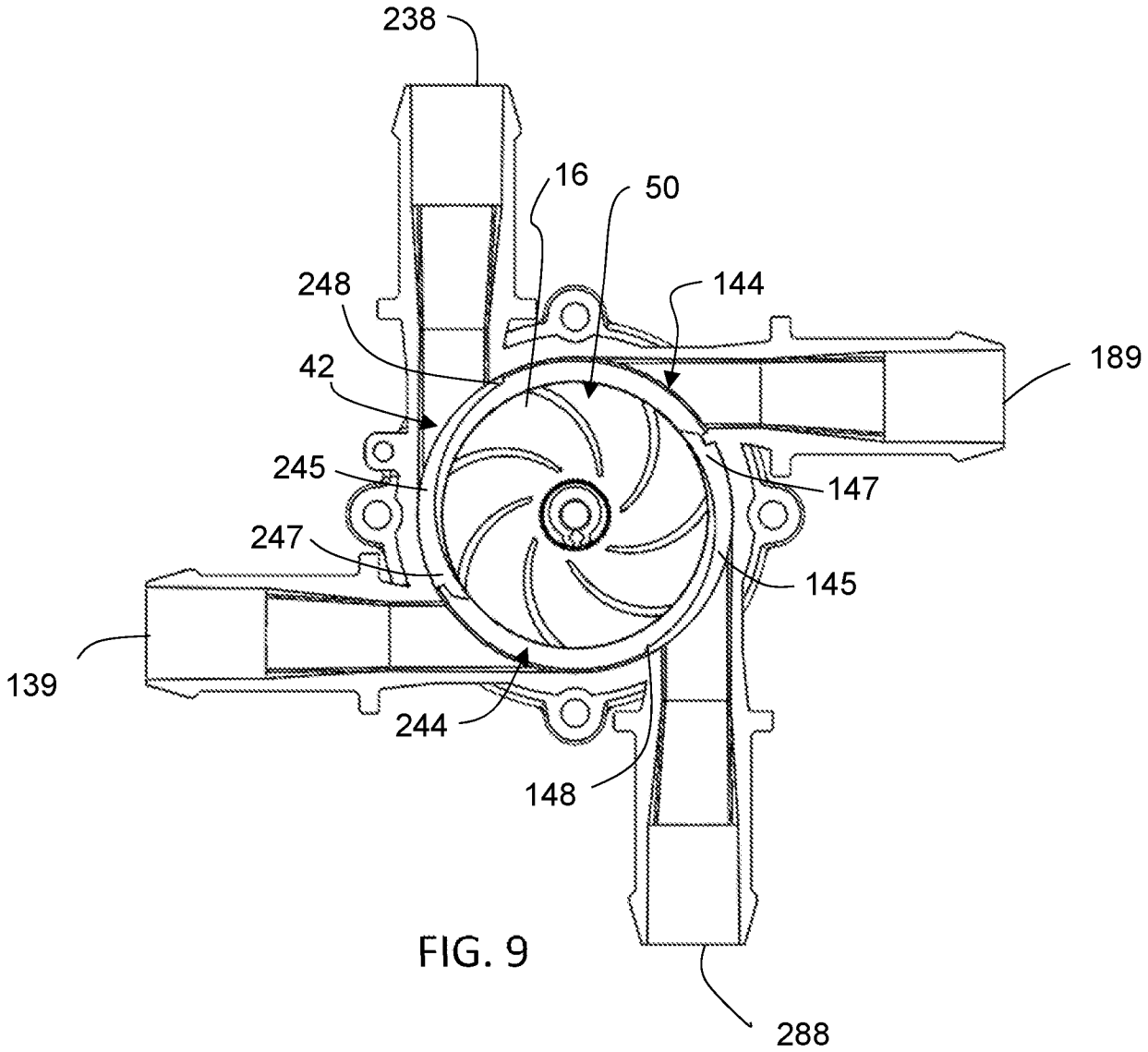
FIG. 9 illustrates a cross-sectional view through a portion of the assembled pump assembly of the second embodiment of the present disclosure having four fluid outlet ports.

FIG. 9 illustrates an example of the second embodiment of the present disclosure having a fourth outlet port 238. In this arrangement, the first opening 144 and the second opening 244 of the valve member 42 opens or closes an associated pair of fluid outlet ports. For example, FIG. 9 illustrates openings 144 and 244 aligned with first fluid outlet port 189 and second fluid outlet port 139, respectively. Fluid in pump cavity 50 is directed through openings 144 and 244 to both the first and the second fluid outlet port 189 and 139. A clockwise or a counter-clockwise rotation of valve member 42, as explained above for FIG. 7, places walls 145 and 245 in a position that closes fluid outlet ports 139 and 189. At the same time, first opening 144 opens to the third fluid outlet port 288 and second opening 244 opens to the fourth fluid outlet port 238 allowing fluid to flow from the pump cavity 50 to both the third and fourth fluid outlet ports 288 and 238, concurrently.

As will be appreciated by those skilled in the art, rotation of the valve member 42 allows fluid to be closed to or opened to complementary pairs of fluid outlet ports. The valve member 42 may also be rotated to place both the first and second openings 144 and 244 to have fluid flow shared between all fluid outlet ports 189, 139, 238 and 288. That is, the valve member 42 may be rotated to position first and second openings 144 and 244 into a position where approximately one-half of the fluid volume from pump cavity 50 is output through the associated pair of first and second fluid outlet ports 189 and 139 and approximately the remainder one-half of the fluid from pump cavity 50 through the associated pair of third and fourth fluid outlet ports 288 and 238. It will be well understood by those skilled in the art that based on the location of the first and second openings 144 and 244, other proportional output volumes may be discharged from the fluid outlet ports as was explained above in FIG. 5C.

It may be advantageous to set forth definitions of certain words and phrases used throughout this patent document. The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The description in the present application should not be read as implying that any particular element, step, or function is an essential or critical element that must be included in the claim scope. The scope of patented subject matter is defined only by the allowed claims. Moreover, none of the claims is intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," or "controller" within a claim is understood and intended to refer to structures known to those skilled in the relevant art, as further modified or enhanced by the features of the claims themselves and is not intended to invoke 35 U.S.C. § 112(f).

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A multiport fluid pump comprising:

a pump housing having a pump cavity;

a fluid inlet conveying fluid into the pump cavity;

a plurality of fluid outlet ports extending from the pump housing;

an impeller for driving the fluid in the pump cavity; and a valve member rotatably mounted between the impeller and the plurality of fluid outlet ports, the valve member having a first and a second wall between a first and a second opening, the first and second openings for concurrently directing the flow of fluid from the pump cavity to at least two of the plurality of fluid outlet ports, wherein the first and second valve member walls each have an interior surface that is spirally voluted from a thicker wall section at a first end to a thinner wall section at a second end.

2. The multiport fluid pump of claim 1, wherein the impeller is arranged to rotate inside the valve member voluted interior surface directing the flow of fluid through the first opening and the second opening from the pump cavity.

3. The multiport fluid pump of claim 2, further comprising an actuation ring mounted to the valve member for causing movement of the valve member and wherein the actuation ring includes a gear band.

4. The multiport fluid pump of claim 3, further comprising an actuator motor having a worm gear engaged with the gear band the actuator motor driving the actuation ring to rotate the valve member.

5. The multiport fluid pump of claim 4, wherein the plurality of fluid outlet ports includes at least a first fluid outlet port and a second fluid outlet port and the actuator motor drives the valve member to rotatably move the valve member to position the valve member first opening between the first fluid outlet port and the pump cavity and to position the valve member second opening between the second fluid outlet port and the pump cavity directing the flow of fluid from the pump cavity to the first and the second fluid outlet ports.

6. The multiport fluid pump of claim 5, wherein the plurality of fluid outlet ports includes a third fluid outlet port and the actuator motor drives the valve member to rotatably move the valve member to position the valve member first opening between the third fluid outlet port and the pump cavity directing the flow of fluid from the pump cavity to the third fluid outlet port and to position the first wall and the second wall to close fluid flow to the first and the second fluid outlet ports.

7. The multiport fluid pump of claim 6, wherein the plurality of fluid outlet ports includes a fourth fluid outlet port and the actuator motor drives the valve member to rotatably move the valve member to position the valve member first opening between the first fluid outlet port and the pump cavity and the second opening between the second fluid output port and the pump cavity and the first wall to close fluid flow to the third fluid outlet port and the second wall to close fluid flow to the fourth fluid outlet and directing the flow of fluid from the pump cavity to the first and the second fluid outlet ports.

8. The multiport fluid pump of claim 7, wherein the actuator motor drives the valve member to rotatably move the valve member to position the valve member first opening between the third fluid outlet port and the pump cavity and the second opening between the fourth fluid output port and the pump cavity and the first wall closing fluid flow to the second fluid outlet port and the second wall closing fluid flow to the first fluid outlet port directing the flow of fluid from the pump cavity to the third and the fourth fluid outlet ports.

* * * * *